US007966936B1

(12) United States Patent
Gieseke

(10) Patent No.: US 7,966,936 B1
(45) Date of Patent: Jun. 28, 2011

(54) TELESCOPING CAVITATOR

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 181 days.

(21) Appl. No.: 12/383,081

(22) Filed: Mar. 13, 2009

(51) Int. Cl.
*F42B 15/20* (2006.01)

(52) U.S. Cl. ..... 102/399; 114/20.1

(58) Field of Classification Search ..... 102/399, 102/390; 114/23, 20.1, 21.1
See application file for complete search history.

(56) References Cited

U.S. PATENT DOCUMENTS

| | | | | |
|---|---|---|---|---|
| 2,889,772 | A * | 6/1959 | Howard | 102/390 |
| 3,434,425 | A * | 3/1969 | Critcher | 102/399 |
| 5,929,370 | A * | 7/1999 | Brown et al. | 102/399 |
| 5,955,698 | A * | 9/1999 | Harkins et al. | 102/399 |
| H1938 | H * | 2/2001 | Harkins et al. | 102/399 |
| 6,962,121 | B1 * | 11/2005 | Kuklinski | 114/67 A |
| 7,243,609 | B1 * | 7/2007 | Ansay et al. | 114/316 |
| 7,428,870 | B1 * | 9/2008 | Nedderman | 102/399 |
| 7,690,309 | B1 * | 4/2010 | Kuklinski | 102/399 |
| 7,779,759 | B2 * | 8/2010 | Paulic et al. | 102/399 |
| 2004/0231552 | A1 * | 11/2004 | Mayersak | 102/519 |
| 2009/0173248 | A1 * | 7/2009 | Fu | 102/399 |
| 2009/0173249 | A1 * | 7/2009 | Fu | 102/399 |
| 2010/0071605 | A1 * | 3/2010 | Kuklinski | 114/23 |

FOREIGN PATENT DOCUMENTS

DE 1126274 B1 * 4/1959

* cited by examiner

*Primary Examiner* — Benjamin P Lee
(74) *Attorney, Agent, or Firm* — James M. Kasischke; Jean-Paul A. Nasser; Michael P. Stanley

(57) ABSTRACT

A high speed underwater projectile configuration that includes a cylindrical telescoping cavitator design capable of providing projectile nose shape change where such change to the projectile nose tip geometry results in supercavitation and a concomitant vaporous cavity in the water that reduces projectile drag resistance while maximizing projectile range and where the projectile nose tip further includes a retractable cavitator piston feature. The projectile nose is designed to house a cylindrical cavitator piston that protrudes forward from the projectile and is held in place until launch. Velocity induced hydrodynamic forces on the forward face of this cavitator piston cause the piston to start moving aft and to gradually cause the piston to retract into the projectile nose, until a larger, secondary cavitator is exposed to the vaporous cavity.

7 Claims, 2 Drawing Sheets

TELESCOPING CAVITATOR

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention relates to high velocity underwater projectiles and more specifically to an underwater projectile configuration that includes a cylindrical telescoping cavitator piston design capable of changing the shape of the projectile nose where such change to the projectile nose tip geometry results in a controllable supercavitation produced vaporous cavity that reduces projectile drag resistance while maximizing projectile range and where the projectile nose tip further includes a retractable piston feature. The projectile nose is designed to house a cylindrical cavitator piston that protrudes forward from the projectile at launch. Velocity induced forces on this cavitator piston cause the piston to gradually retract into the projectile nose, until a larger, secondary cavitator is exposed to the vaporous cavity.

(2) Description of the Prior Art

The U.S. Navy is developing underwater gun systems for use in anti-mine and anti-torpedo operations. A basic gun system includes underwater ballistic projectiles, an underwater gun, a ship-mounted turret, a targeting system, and a combat system. The underwater gun shoots the underwater projectiles that are specially designed for rapid neutralization of undersea targets at relatively long ranges of up to 200 meters. The undersea targets are identified and localized with specialized targeting systems, and the combat system provides the control commands to direct the ship-mounted turret to point the gun towards the target.

Referring now to FIG. 1, there is shown a typical prior art tapered supercavitating projectile generally identified as 10. Projectile 10, once fired from an underwater gun, can accurately travel relatively large distances by making use of the phenomenon known as the supercavitation effect. Supercavitation occurs when projectile body 12 travels through water 14 at very high speeds and a vaporous cavity 16 forms at its forward tip 18. With proper projectile design, the vaporous cavity can extend back beyond the projectile back end 20 so as to envelop the entire projectile. Because the enveloped projectile is not in direct contact with the water, excluding the small cavitator tip and an occasional collision with the cavity wall, known as "tail slap", the viscous drag on projectile body 12 is significantly reduced over the drag that would be experienced by a fully wetted projectile body.

FIG. 2*a* shows an alternate tapered supercavitating projectile shape generally referred to as 40. At launch, a vaporous cavity 16 is formed, the size of which is a function of the projectile speed and the projectile size and shape. As a typical supercavitating projectile 40 begins to travel down-range, it starts to slow down due to the drag generated at its tip and the corresponding cavity shrinkage that the drag generates. Cavity 16 continues to shrink as projectile 40 decelerates until the cavity can no longer envelop the entire projectile at which point drag greatly increases and the projectile slows dramatically. The prior art has also postulated that a secondary cavitator 42, aft of primary cavitator 44, and representing a step in the projectile 46 body profile, can be used to continue to produce a cavity 16 after the cavity from primary cavitator 44 shrinks below a certain point. This effect is shown in FIG. 2*b* where a shrinking forward cavity segment 16*a* continues to collapse while cavity 16 transitions to secondary cavitator 42 and extends aft to continue to envelope the bulk of projectile 46.

The difficulty with this fixed geometry approach is that very tight tolerances must be maintained in the location and size of the secondary cavitator 42 for it to be effective. If cavitator 42 is too large or placed too far forward it will interfere with cavity generation by the primary cavitatator 44. If it is too far aft or too small, it will never engage the cavity boundary and the cavity will close on the afterbody 46 of projectile 40 rather than on secondary cavitator 42.

What is needed is to improve the stepped cavitator concept in such a way as to improve its effectiveness throughout the supercavitating projectile's flight.

SUMMARY OF THE INVENTION

It is a general purpose and object of the present invention to provide a telescoping primary cavitator disposed within a high speed projectile nose;

It is a further object that the telescoping primary cavitator controllably and smoothly transitions a formed vaporous supercavitation cavity to a secondary cavitator while in flight;

Another object is to have the primary cavitator recede into the projectile nose at a controlled rate so as to maintain the drag reducing cavity over the projectile body for as long as possible;

These objects are accomplished with the present invention by providing a high speed underwater projectile configuration that includes a cylindrical telescoping cavitator design capable of providing projectile nose shape change where such change to the projectile nose tip geometry results in supercavitation and a concomitant vaporous cavity in the water that reduces projectile drag resistance while maximizing projectile range and where the projectile nose tip further includes a retractable cavitator piston feature. The projectile nose is designed to house a cylindrical cavitator piston that protrudes forward from the projectile and is held in place until launch. Velocity induced hydrodynamic forces on the forward face of this cavitator piston cause the piston to start moving aft and to gradually cause the piston to retract into the projectile nose, until a larger, secondary cavitator is exposed to the vaporous cavity.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE INVENTION

With reference to the above described drawings wherein like numerals represent like parts throughout the several figures, there is shown a telescoping cavitator piston system in accordance with the teachings of the present invention.

Rather than relying on the velocity decay of a high speed projectile to engage a secondary cavitator, a variable geometry configuration is now described where the primary cavitator is movable and is allowed to transit backwards at a controlled rate as the projectile travels through the water. The combined action of changes in the forward cavitator geometry and the reduction in size of the vaporous cavity due to projectile slowing induce the secondary cavitator to engage the vaporous cavity at precisely the desired point in the projectile trajectory.

Figure 1:
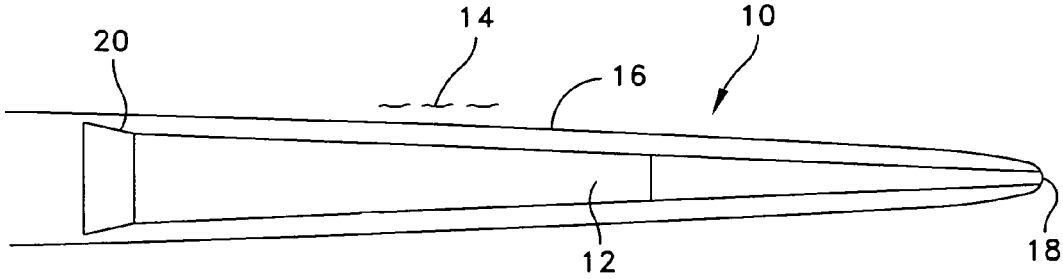
FIG. 1 (PRIOR ART)
FIG. 1 shows a typical prior art supercavitating projectile within a self generated vaporous cavity.
Figure 2A:
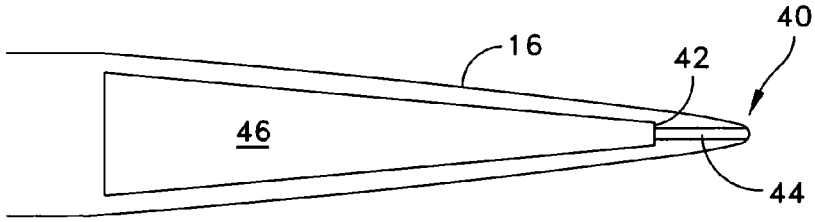
FIG. 2a (PRIOR ART)
FIGS. 2*a* and *b* show a typical prior art depiction of primary and secondary cavitation effects on cavity formation respectively.
Figure 2B:
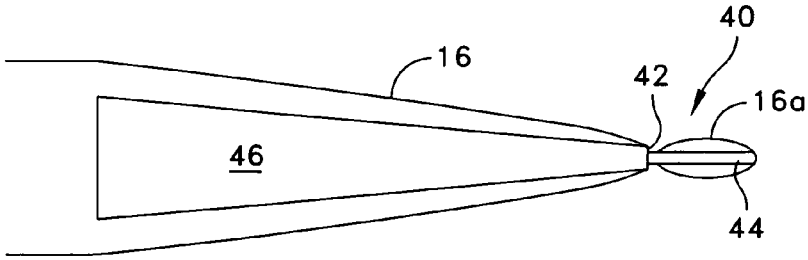
FIG. 2b (PRIOR ART)
Figure 3:
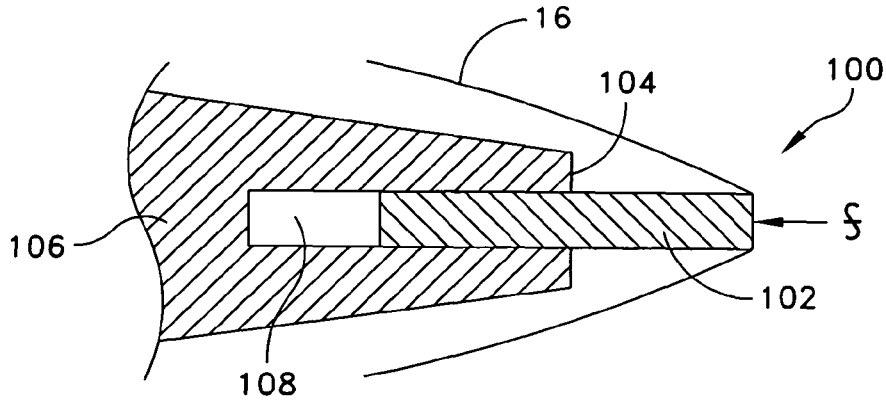
FIG. 3 shows a cross sectional view of the nose of a projectile made according to the teachings of the present invention and having its primary cavitator fully extended.
Figure 4:
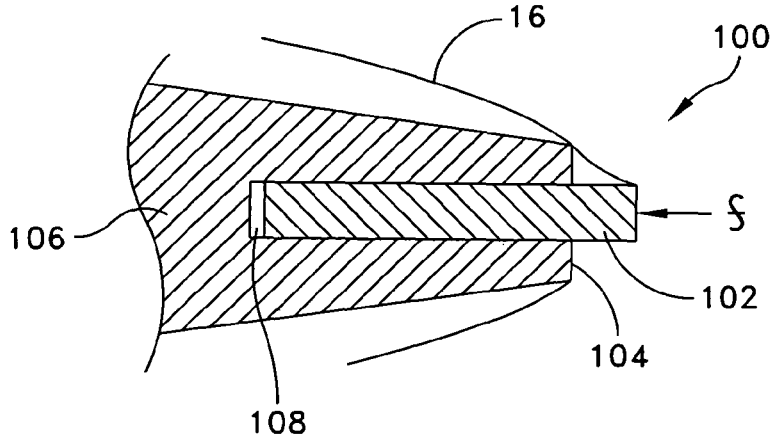
FIG. 4 shows a cross sectional view of the nose of a projectile made according to the teachings of the present invention and having its primary cavitator fully retracted.
Figure 5:
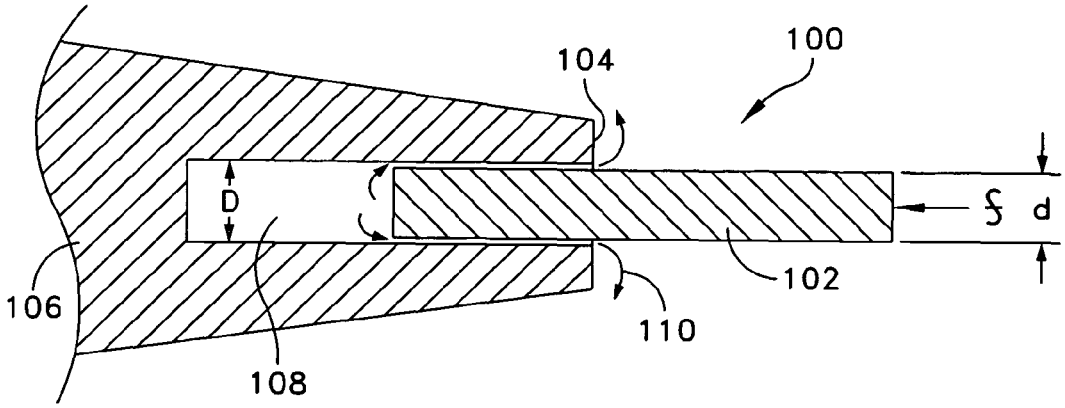
FIG. 5 shows an enlarged cross sectional view of the device of FIGS. 3&4 further depicting operational details of the primary cavitator piston.

FIG. 3 illustrates the basic telescoping cavitator design concept generally identified as 100. Initially, a primary cavitator piston 102 extends from the nose 104 of projectile 106 with a portion of piston 102 residing in a cylindrical cavity 108 and a portion extending beyond nose 104. Nose 104 also serves as the secondary cavitator. In flight vaporous cavity 16 extends aft from the nose of piston 102 and fully envelopes the projectile. Upon firing of the projectile, hydrodynamic force f on piston 102 forces it in the aft direction until piston 102 reaches the position at the bottom of cavity 108 shown in FIG. 4. At this point, vaporous cavity 16 transitions fully to secondary cavitator 104. However, as illustrated in greater detail in FIG. 5, a fluid 110 is provided in cavity 108 behind cavitator piston 102. Piston 102 can be held in place in its forward position by a temporary restraint mechanism which releases after launch. Fluid 110 prevents the piston from rapidly sliding aft at launch. Instead, fluid 110 in cavity 108 is forced at a controlled rate through the small annulus of preselected size formed between the outside diameter d of piston cavitator 102 and the inside diameter D of cavity 108 in the projectile nose. Fluid 110 is shown in FIG. 5 as flowing past piston 102 and out into the surrounding medium.

The time during projectile flight at which secondary cavitator 104 is engaged by the flow is determined by the rate at which the piston cavitator retracts into the projectile nose. This rate in turn is controlled by the size of the annulus D-d, the viscosity of the constrained fluid and the motion produced load f on the piston cavitator 102 face.

The design of the primary cavitator 102 of the present invention has the advantage of producing low drag at high speeds, but the projectile decelerates during flight and at some point cavitator 102 becomes too small to sustain the vaporous cavity and hence high speed projectile flight. At this point secondary cavitator 104 is engaged and the larger vaporous cavity is sustained for a considerably longer period.

The primary advantage of the telescoping cavitator design described here is that it provides significantly longer range and accuracy as compared to the limited range and accuracy of existing fixed cavitator high speed underwater projectiles because the vaporous cavity is sustained longer.

What has thus been described is a high speed underwater projectile configuration that includes a cylindrical telescoping cavitator design capable of providing projectile nose shape change where such change to the projectile nose tip geometry results in supercavitation and a concomitant vaporous cavity in the water that reduces projectile drag resistance while maximizing projectile range and where the projectile nose tip further includes a retractable cavitator piston feature. The projectile nose is designed to house a cylindrical cavitator piston that protrudes forward from the projectile and is held in place until launch. Velocity induced hydrodynamic forces on the forward face of this cavitator piston cause the piston to start moving aft and to gradually cause the piston to retract into the projectile nose, until a larger, secondary cavitator is exposed to the vaporous cavity.

Obviously many modifications and variations of the present invention may become apparent in light of the above teachings. For example: a method of restraining the piston cavitator in its forward position prior to flight can be included. Any adhesive or highly viscous sealant or mechanical detent that releases under launch loads would serve such a purpose well; also multiple stages of telescoping pistons can be used to provide improved performance.

In light of the above, it is therefore understood that within the scope of the appended claims, the invention may be practiced otherwise than as specifically described.

What is claimed is:

1. A telescoping cavitator system for a high speed underwater projectile, the projectile having a forward end, and aft end and a tapered body increasing in diameter from the forward tip to the aft end, the cavitator system comprising:

a first cavitator shaped to induce supercavitation, disposed at said forward tip of said projectile, said first cavitator having a cylindrical body of preselected length and a diameter d;

a second cavitator, disposed aft of said first cavitator, said second cavitator having an outside diameter greater than that of said first cavitator and also having a cylindrical cavity therein with an inside diameter D adapted to slideably receive said outside diameter d of said first cavitator therewithin, for providing in cooperation a moveable piston assembly; and a fluid medium, filling said cylindrical cavity volume behind said first cavitator piston, to restrict rearward movement of said piston in a controlled manner, said piston moving aft once said projectile has been fired.

2. The system of claim 1 wherein the space between said cylindrical cavity inside diameter D and said first cavitator outside diameter d is an annulus defined by D-d where selection of annulus cross sectional area and the viscosity of said fluid medium determines the rate of movement aft of first cavitator piston.

3. The system of claim 2 further comprising a first cavitator piston restraint means, adapted to grip said piston at its forwardmost position at the end of said cylindrical cavity in the ready to launch position, for securing and controllably releasing said piston thereby allowing said piston to move aft upon said projectile being launched.

4. The system of claim 3 wherein said fluid medium is silicone fluid.

5. The system of claim 4 wherein said piston restraint means is a highly viscous sealant.

6. The system of claim 3 wherein said fluid medium is hydraulic fluid.

7. The system of claim 6 wherein said piston restraint means is a highly viscous sealant.

* * * * *